United States Patent [19]

Gradwell et al.

[11] Patent Number: 4,921,631

[45] Date of Patent: May 1, 1990

[54] BLEACH ACTIVATOR COMPOSITIONS

[75] Inventors: Anthony J. Gradwell; John D. Withenshaw, both of Holywell, England

[73] Assignee: Warwick International Limited, England

[21] Appl. No.: 194,030

[22] Filed: May 12, 1988

[51] Int. Cl.[5] ..... D06L 3/02; C11D 3/39

[52] U.S. Cl. ..... 252/186.38; 252/186.22; 252/186.23; 252/186.42; 252/186.43; 252/102; 252/95; 252/99; 252/186.2

[58] Field of Search ..... 252/186.38, 186.42, 252/186.43, 186.22, 186.23, 95, 99, 102

[56] References Cited

U.S. PATENT DOCUMENTS

| | | | |
|---|---|---|---|
| 4,283,301 | 8/1981 | Diehl | 252/186.22 X |
| 4,399,049 | 8/1983 | Gray et al. | 252/186.25 X |
| 4,606,838 | 8/1986 | Burns | 252/186.38 X |
| 4,619,779 | 10/1986 | Hardy | 252/186.26 X |
| 4,642,197 | 2/1987 | Kruse et al. | 252/186.25 X |
| 4,681,592 | 7/1987 | Hardy et al. | 252/186.38 X |

FOREIGN PATENT DOCUMENTS

| | | |
|---|---|---|
| 62523 | 10/1982 | European Pat. Off. . |
| 106634 | 4/1984 | European Pat. Off. . |
| 163331 | 12/1985 | European Pat. Off. . |
| 195597 | 9/1986 | European Pat. Off. . |
| 195663 | 9/1986 | European Pat. Off. . |
| 3514877 | 11/1986 | Fed. Rep. of Germany . |
| 2053998 | 2/1981 | United Kingdom . |
| 2125453 | 3/1984 | United Kingdom . |
| 2178075 | 2/1987 | United Kingdom . |

*Primary Examiner*—Brooks H. Hunt
*Assistant Examiner*—Virginia B. Caress
*Attorney, Agent, or Firm*—Ostrolenk, Faber, Gerb & Soffen

[57] ABSTRACT

An extruded particulate body comprises a binder, usually having a melting point in the range 20°–80° C., with particulate bleach activator and particulate water-soluble disintegration aid substantially uniformly distributed throughout the body. The bleach activator is a mixture of a relatively non-surface active bleach activator, preferably tetra-acetylethylene diamine, and a relatively surface active activator, usually a $C_{6-10}$ alkanoyloxy benzene sulphonate. The disintegration aid is usually a bleach stabilizor preferably a phosphonic acid or salt thereof. The extruded bodies are for incorporation into a particulate detergent formulation which contains a peroxy bleach component.

17 Claims, No Drawings

BLEACH ACTIVATOR COMPOSITIONS

The present invention relates to extruded bodies containing bleach activator and bleach—containing detergent compositions comprising the bodies.

In EP-A-0062523 a process for producing an extrudate of a storage sensitive detergent additive material is described, in which a friable mass of the particulate additive and a melted nonionic ethoxylated surfactant is extruded through a screen. Many examples of suitable storage-sensitive materials are given, one of the preferred examples being a bleach activator. Many examples of bleach activators are disclosed, all of the examples being relatively non-surface active bleach activators. The bodies may contain a particulate dispersant in intimate mixture with the additive, examples of such dispersants being water-soluble inorganic salts and organic polyacids and their salts. The problem with the activators exemplified is that they are insufficiently effective on sebum stains (lipid—and/or squalene—derived stains and skin cell deposits).

In GB2178075 extruded bodies containing binder, a bleach activator compound, e.g. a long chain acyloxy benzene sulphonate, and a peroxygen bleach compound are described.

In US4283301 a class of long-chain acyl and diacyl derivatives is useful as relatively surface active bleach activators is described. The acyl groups comprise hydrocarbyl groups optionally in combination with ethylene oxide groups. The long chain acyl compounds are stated to have superior activity at relatively low wash temperatures. The activators are generally supplied in separate compositions to the bleach composition and the detergent composition, although under some circumstances the activator may be incorporated in the dry detergent mixture, presumably as activator powder.

In EP-A-195597 and EP-A-195663 further examples of relatively surface active bleach activators are disclosed. In the former the activators yield $C_{4-8}$ alkoxy aromatic peroxy acids in a bleaching composition and in the latter the activators yield a long chain alkyl peroxy acid in a bleaching composition. There is no specific disclosure of the form in which the activators are presented in a detergent formulation.

In EP-A-0106634 relatively surface active activators which produce long chain alkyl peroxy acids in a bleaching composition are provided in the form of bodies comprising activator and binder, in the form of granules of extrudate e.g. formed by extruding a friable mixture of binder material with activator powder. The binder may be nonionic or anionic and may be in melted or solution form during extrusion. The example appears to use an aqueous solution of an anionic surfactant and nonionic surfactants are less preferred. It is stated that the bodies may contain other components usual in detergent compositions so long as they are inert with respect to the activator and binder. There is no disclosure of how any such components would be incorporated but in the example it appears that water-soluble components (e.g. sodium sulphate) are incorporated in aqueous solution.

A problem with the process exemplified in EP-A106634 is that the bleach activators used are rapidly soluble in water and dissolve in any water used during processing to produce an unmanageable mass. The use of water which acts as a solvent also prevents the extrusion of a mass containing peroxygen bleaching compound as well as activator since the components would react prematurely.

In GB-A-2125453 (EP-A-98129) bleach activators are provided in combination with a substrate that is flexible and non-water soluble, usually a sheet of non-woven material or a sponge. The piece of non-woven or sponge is added to the wash, with the detergent composition being added separately. This form of presentation is inconvenient as it requires separate addition to the wash, the substrate can lead to blockages in the washing machine and some components of the substrate may be dispensed into the wash liquor which can be desirable. Also the manufacturing process and extra packaging required are undesirable.

Although the surface active bleach activators have relatively good activity on some types of stains they are relatively ineffective on oxidisable stains such as red wine and tea and, since the activators have a relatively high molecular weight correspondingly higher amounts than for conventional bleach activators need to be incorporated for reaction with peroxy acid bleach. It would be desirable to provide more economic particulate bleach activator compositions which show the benefit of the long chain acyl activators but which are required in lower weights in particulate detergent compositions.

According to the invention a bleach activator body comprises (a) 50 to 97.5% of particulate bleach activator, (b) 0.5 to 40% of a particulate water-soluble disintegration aid, and (c) 2 to 45% of a binder selected from nonionic surfactants, polyethylene glycols, non-ionic, film-forming polymers, and mixtures thereof, said binder having a melting point of at least 20° C., wherein the components are substantially evenly distributed throughout the body, and is characterised in that the bleach activator is a mixture of a relatively surface active bleach activator and a relatively non-surface active bleach activator.

In a suitable body according to the invention the bleach activator compounds are present in a weight ratio in the range 1:10 to 10:1, preferably in the range 1:3 to 3:1, more preferably about 1:1, the body having been prepared by extrusion.

In the invention there is also provided a new process for producing the bodies in which a mixture of melted binder containing the other components in pariculate form dispersed in the binder substantially free of water and other solvents for the solid components is extruded and cooled to form the bodies.

The bleach activator particles generally have sizes in the range 10 to 500μm. Sometimes it is preferable to use very small particles, for instance most, e.g. around 90% by weight, of the particles having sizes less than 100μm and around 50 or 60% having sizes less than 50μm. Sometimes it may be desirable to use larger particles for instance substantially all the particles having sizes in the range 50 to 500μm.

In this invention, by relatively surface active bleach activators we mean those which produce in an aqueous bleaching composition containing a peroxygen bleaching compound a relatively surface active carboxy peroxy acid, i.e. one with hydrophobic characteristics.

The relatively surface active bleach activators are, for instance, those which produce peroxy acids and diacids having hydrocarbyl groups containing 5 to 20 carbon atoms, optionally including one or a plurality of lower alkyleneoxy groups e.g. ethylenoxy groups. The hydrocarbyl group may be optionally substituted alkyl, aralkyl, alkaryl or aryl. Preferred examples are $C_{5-15}$ alkyl, preferably $C_{5-9}$ alkyl, usually where the longest linear alkyl chain is 5-10 carbon atoms long. Another preferred class is aryl, in which the phenyl group is substituted by $C_{4-8}$ alkoxy.

The relatively non-surface active bleach activators are those which produce in an aqueous bleach composition containing a peroxygen bleaching compound a relatively non-surface active carboxy peroxy acid, i.e. one with relatively hydrophilic characteristics. The peroxy acid is usually a $C_{1-4}$ aliphatic carboxyperacid, usually a $C_2$ or $C_3$ peroxy acid and most preferably the acetyl derivative.

In each case the activators themselves are mono- or di-functional acyl derivatives or, less frequently, derivatives e.g. esters of imidic acids (imidates); examples of acyl derivative are esters including esters of enols, imides, including glycourils, acylated urea derivatives, acylated hydantion dervatives and N, N-diacyl methylenediformamides, imidazoles and oximes as well as triacyl guamidines, acyl sulphonamides, triazine derivatives, and piperazine derivatives. Preferred derivatives are imides, oximes and esters, especially optionally substituted phenol esters and imides. The various types of activator disclosed in EP62523 can be used with suitable acyl groups to provide the desired surface activity in the peroxy acid produced on dissolution in the aqueous bleaching composition.

The relatively surface active bleach activator is, for instance, any of the compounds disclosed in EP106634, EP195597, EP195663 and US4283301.

The most preferred relatively surface active bleach activators have the formula:

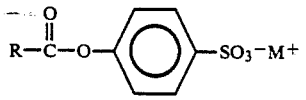

wherein R is an alkyl chain containing from 5 to 9 and preferably from 7 to 9 carbon atoms and M is sodium or potassium. The bleach activator is preferably isononanoyloxy benzene sulphonate sodium salt or the linear octanoyloxy analogue.

The particulate relatively non-surface active bleach activator is preferably tetra acetyl ethylene diamine but may be any of the known relatively non-surface active detergent bleach activators, such as those described in EP-A-0062523. Other preferred activators include polyacetyl mono-, di-, or polysaccharides such as penta acetyl glucose, glycourils such as tetra acetyl glycouril, N-acyl amides, acylated diketopiperazines, and other N-acyl amines, in which the acyl group(s) each has less than 5 usually 2 carbon atoms.

The disintegration aid can be any water soluble material that will promote rupture of the body and exposure of the activator particles to the water. It is advantageous if the granule disintegration aid has stabilising properties upon the peracid species formed on the reaction of the bleach and the activators. By using these stabilising compounds it is possible to maintain the peracid activity over an extended period in the wash as compared to compositions free if the compounds. Thus the activity of the bleach species at 40° C. after 30 minutes can be maintained at, or close to, the activity at 40° C. after 5 minutes.

Preferably the disintegration aid is a sequestering agent or mixture of sequestering agents. It may be an amino carboxylic acid sequestering agent, for instance nitrilo triacetic acid (NTA) or ehtylene diamine tetra acetic (EDTA) acid or diethylene triamine penta acetic acid (DTPA) (or salts thereof) or a low molecular weight anionic polymer formed from ethylenically unsaturated monomers e.g. unsaturated carboxylic acid or sulphonic acid monomers, such as acrylic acid, but preferably the granulating aid is a phosphonic acid sequestrant or stabiliser.

Any of the phosphonic acid compounds conventionally present in detergents as stabilisers or sequestrants and that can be provided in solid form e.g. by spray drying aqueous solutions or by adsorbing liquid compounds onto absorbent particulate solids,e .g. of a silicate materials, may be used including ethylene diamine tetra (methylene phosphonic acid) (EDTMP) for instance as the free acid or as the hexa sodium salt, diethylene triamine penta (methylene phosphonic acid) (DEPMP), hexamethylene diamine tetraphosphonic acid (HMDTP), nitrilotrismethylenephosphonic acid (NTMP) or its sodium salt or hydroxyethyl-1, 1-diphosphonic acid (HEDP). The phosphonic acids may be present in the body as free acid or as acceptable and active salts which are solid e.g. with ammonia, alkali metal (generally sodium) or alkaline earth metal (generally calcium) or as complexes with, for instance, zinc or aluminium. The phosphonic acids have the further property that they enhance the stability of the peracid species formed during the reaction of the bleach and the bleach activator.

The disintegration aid advantageously comprises, in addition to such sequestering agents, water-soluble inorganic salts, such as alkali metal or alkaline earth metal salts, preferably sodium, potassium, calcium or magnesium salts or mixtures. The salts may be the water-soluble sulphates, carbonates or halides, usually chlorides. Mixtures can be used. Preferably hygroscopic salts are used to promote the most rapid dissolution of activator. Particularly suitable example is sodium sulphate.

The materials that can be utilized as binders are nonionic surfactants, polyethylene glycols, and mixtures thereof. It is believed that such binder materials are not reactive with the bleach activator and, if in a detergent composition, not reactive with the components of the detergent composition upon storage. Also, they have low hygroscopicity upon storage but are nevertheless soluble and, therefore, dispersible in the wash water. However, it is preferable that such binder materials do not melt below about 40° C. Otherwise, the binder is likely to melt upon storage because often the storage temperature is as high as 40° C. Naturally, the melting of the binder material results in the bleach activator being quite unstable. Preferred binders have a melting point below 80° C., preferably below 60° C., in order that the bodies can be provided by extrusion of a composition comprising a melt of the binder, in the substantial absence of water or the other solvent.

Examples of nonionic surfactants that can be utilized as a binder material are the condensation product of primary or secondary aliphatic alcohols having from 8 to 24 carbon atoms, in either straight chain or branched chain configuration, with from 10 to 100 moles, preferably 20 to about 50 moles of ethylene oxide per mole of alcohol. Preferably, the aliphatic alcohol comprises between 9 and 18 carbon atoms and is ethoxylated with between 10 and 50, desirably between 20 and 40 moles of ethylene oxide per mole of aliphatic alcohol. The preferred nonionic surfactants are prepared from primary alcohols which are either linear (such as those derived from natural fats or, prepared by the Ziegler process from ethylene, e.g., myristyl, cetyl, stearyl alcohols), or partly branched such as the Dobanols and Neodols which have about 25% 2-methyl branching (Dobanol and Neodol being Trade Names of Shell) or Synperonics, which are understood to have about 50% 2-methyl branching (Synperonic is a Trade Name of I.C.I.) or the primary alcohols having more than 50% branched chain structure sold under the Trade Name Lial by Liquichimica.

Other suitable nonionic surfactants are the polyethylene oxide condensates or alkyl phenol, e.g., the condensation products of alkyl phenols having an alkyl group containing from 6 to 12 carbon atoms in either a straingt chain or branched chain configuration, with ethylene oxide, the said ethylene oxide being present in amounts equal to 35 to 100, preferably 40 to 80 moles of ethylene oxide per mole of alkyl phenol. The alkyl substituent in such compounds may be derived, for example, from polymerised propylene, di-isobutylene, octene and nonene.

Still further nonionic surfactants suitable for use herein are the compounds formed by condensing ethylene oxide with a hydrophobic base formed by the condensation of propylene oxide and propylene glycol. The molecular weight of the hydrophobic portion generally falls in the range of 1500 and 1800. Such synthetic nonionic detergents are available on the market under the Trade Name of "Pluronic" supplied by Wyandotte Chemicals Corporation.

Suitable polyethylene glycols, which are homopolymers of ethylene oxide having the general formula $$HO(C_2H_4O)_nH,$$

have an average molecular weight of from 2,000 to 15,000, preferably from 3,000 to 10,000 and most preferably from 4,000 to 8,000.

Very small levels of binder material within the body are required. The level of binder material within the bodies within the invention is from 2% to 45% and preferably from 4% to 20%.

The activators should be provided in the form of small particles generally having an average particle size in the range 50 to 500 microns, preferably 100 to 300 microns, Preferably substantially none of the particles has a size above 300 microns or, at the most, 500 microns. The particulate binder preferably has an average particle size below 200 microns, generally below 100 microns and is preferably free of particles above 200 microns in size.

It may be desirable to include in the body a particulate peroxygen bleaching compound. Although the bodies will in this case contain both bleach compound and bleach activator the bodies are still satisfactorily storage stable since the two components are present together during processing as well as in the product in the substantial absence of water and thus do not react.

Although the body preferably consists substantially only of the activators binder and disintegration aid(s) other components of the final detergent may be included if desired in any suitable amounts. Preferably however such additions provide less than 10% and generally less than 5% by weight of the body. One component that can usefully be included in the body is optical brightening agent since its incorporation in the body avoids the problems associated with incorporating it in the remainder of the detergent composition. For instance it may be damaged by the spray drying to which the remainder of the composition is generally subjected. Another component that can conveniently be incorporated is an antisudsing (anti foaming) or foam stabilising agent. Other components that may be included are other components of detergent compositions such as surfactants, anti-redeposition acids, builders, pigments or dyes and enzymes.

The extrudate bodies preferably have an average diameter of between 300 and 2000 microns, most preferably 500 to 1500 microns. The bodies preferably have longitudinal dimensions in the range 1 to 6 mm. Preferably none of the bodies have a length below 100 microns and most preferably none have a length below about 500 microns. Preferably most bodies are less than 6 mm long, more preferably less than 4 mm long. Bodies that are too fine are preferably separated from the rest and recycled for further extrusion.

Preferably the density of the body is above 1.6 g/cm$^3$, preferably above 1.08 and most preferably in the range 1.10 to 1.30 g/cm$^3$.

The activator bodies are made by mixing the particulate activator and disintegrating aid solids with liquid binder to form a substantially homogeneous friable mass and then mechanically extruding the friable mass. Mixing and extrusion may be continous or a two-phase operation, mixing may for instance be carried out in a twin-screw or a single screw machine. By friable is meant that the mixture of particulate solids and liquid binder prior to extrusion has a moist, somewhat crumbly texture. The relative amount of activator, binder and disintegrating aid can be adjusted to achieve the desired texture. Preferably the amount of binder is in the range 4 to 20% by weight.

The friable mixture of solids and binder is mechanically extruded radially or axially suitably through an apertured screen to form extrudate having the desired sizes.

The resultant bodies can be incorporated in conventional detergent compositions that contain suitable bleach component that reacts with by the activator either within the activator bodies, as described above, or as a separate component in the composition. Sometimes the activator bodies can be incorporated in a detergent composition which contains no bleach component, the bleach component being added to the aqueous detergent solution from a separate composition at the point of use, but this is less preferred. The preferred bleaches are peroxy compounds, especially perborates such as sodium perborate tetrahydrate but others that can be used include sodium perborate monohydrate or sodium percarbonate.

The detergent may contain, in addition to surfactants, detergent builders and anti-redeposition aids, enzymes, anti-sudsing agent, foam stabilisers, optical brightening agents, pigments, dyes and perfumes, sequestrants, halide salts such as sodium bromide, manganese salts such as manganous sulphate and inert fillers such as sodium sulphate or silicate. A particular advantage of the invention is that it is not necessary to include phosphates, although they may be included if desired. The amount of activator, based on the total weight of the detergent, may be conventional or may be less than usual, because of the increased activity. Typical amounts are 1 to 5% based on the total detergent, or 10 to 50% based on the bleach.

The bleach activator bodies of the invention surprisingly provide extremely good bleach activating activity on an extremely wide range of stains, the combined effect of incorporating the two types of activator in the compositions providing activities exceeding those of the single components.

The following examples illustrate the invention.

EXAMPLES

The abbreviations used in the examples have the following meanings:

TAED: tetra acetyl ethylene diamine
ISON: isononanoyl oxybenzene sulphonate sodium salt
EDTMP: ethylene diamine tetra (methylene phosphonic acid)
CMC: carboxy methyl cellulose
PBS 4: sodium perborate tetra hydrate Extruded bodies were formed by mixing particulate bleach activator and any particulate dispersant with melted Genapol T 240 (trade mark) surfactant (an 25 mole ethoxylated C18 alcohol available from Hoeschst) in a twin screw mixer at 50° C. for up to 1 min. to produce a homogeneous mass. This was then extruded through a 1mm screen to produce noodles having lengths within the range 2 to 6mm. The table 1 indicates that relative amounts of components in the noodles.

For comparison purposes bleach activator granules were prepared by dry mixing particulate activator with particulate cellulosic binder for 3 minutes, after which water, containing any disintegration aid, in solution, is added whilst mixing is continued over 2 minutes. The granules are discharged and dried for 15 min. at 60° C. using a fluid bed drier. The average length of the granules was 3–4mm. The relative amounts of the components of the granules are shown in the tables 1.

The noodles or granules were incorporated into a wash solution containing a conventional heavy duty low-temperature powder detergent containing bleach in the amounts indicated in table 2.

The % stain removal from stained tea and wine cloths are determined by changes in reflectance from untreated unwashed cloths to treated washed cloths.

The reflectance of the cloths clean, stained and washed are measured on a ICS computer and the reflectance values recorded.

Wash tests were carried out at 40° C. and 50° C. (HLCC programs 5 and 4 respectively) on red wine and sebum and dust stains using ECE detergent base and 12% sodium perborate tetrahydrate. Hoover computer control 1100 machines were used with a controlled water hardness of 250 ppm calcium carbonate. Stain removal was measured by reflectance using a tristimulus colour analysing computer and the results are shown in table 2.

The value of ΔR % in the table is the percentage difference in stain removal as measured by reflectance from a washed swatch of stained cloth, with the value of ΔR % for the standard composition being given the value 1.

TABLE 1

| | Noodles | | | Granules | |
|---|---|---|---|---|---|
| | I | II | III | IV | V |
| TAED | 84 | — | 40.7 | 91 | 85 |
| ISON | — | 84 | 40.7 | — | — |

TABLE 1-continued

| | Noodles | | | Granules | |
|---|---|---|---|---|---|
| | I | II | III | IV | V |
| EDTMP | — | — | 1.4 | — | 3.0 |
| $Na_2SO_4$ | — | — | 1.2 | — | 2.5 |
| Genapol T 250 | 16 | 16 | 16 | — | — |
| CMC | — | — | — | 8 | 8.5 |
| Water | — | — | — | 1 | 1.0 |

TABLE 2

| Detergent Compositions | Wash Tests | | | | | | | |
|---|---|---|---|---|---|---|---|---|
| | A | B | C | D | E | F | 1 | 2 |
| ECE Base | 84.7 | 84.7 | 84.7 | 84.7 | 81.8 | 81.8 | 81.8 | 84.7 |
| PBS4 | 12 | 12 | 12 | 12 | 12 | 12 | 12 | 12 |
| Activator: | | | | | | | | |
| Type | IV | I | V | II | II | V + II | III | III |
| Amount | 3.3 | 3.3 | 3.3 | 3.3 | 6.2 | 3.1 3.1 | 6.2 | 3.3 |
| ΔR % RW | 12.8 | 14.9 | 23.4 | 6.4 | 14.9 | 21.3 | 32 | 21.3 |
| 40° C. S&D | 2.6 | 2.6 | 1.3 | 5.1 | 11.5 | 6.4 | 7.7 | 5.1 |
| ΔR % RW | 15.0 | 16.7 | 25 | 12.5 | 16.7 | 25 | 37.5 | 23 |
| 50° C. S&D | 1.3 | 2.5 | 2.5 | 7.6 | 7.6 | 6.3 | 7.6 | 5.1 |

(Sebum and dust stain is sold by Testfabrics Incorporated).

The results show that the activator composition of the invention, formula III used in compositions 1 and 2, gives surprisingly improved results over the compositions exemplified in EP-A-0062523 (B) and EP-A-0106634 (D and E) as well as granulated activators contain TAED (A and C) and mixtures (F) an oxidisable stains, exemplified here as red wine stain, and fatty stains, i.e. sebum stains, and that even with low amounts of both activators (composition 1) good results can be achieved.

We claim:

1. A bleach activator body said body having an average diameter of between 300 and 2000 microns and a longitudinal dimension in the range of 1 to 6 mm comprising:
   (a) 50 to 97.5% of particulate bleach activator,
   (b) 0.5 to 40% of a particulate water-soluble disintegration aid, and
   (c) 2 to 45% of a binder selected from nonionic surfactants, polyethylene glycols, non-ionic, film-forming polymers, and mixtures thereof, said binder having a melting point of at least 20° C., wherein the components are substantially evenly distributed throughout the body, in which the bleach activator is a mixture of first and second activators, the first activator being a relatively surface active bleach activator which, in an aqueous solution containing a peroxygen bleaching compound, produces peroxy acids and diacids having hydrocarbyl groups containing 5 to 20 carbon atoms, and the second activator being a relatively non-surface active bleach activator which, in an aqueous solution containing a peroxygen bleaching compounds, produces a $C_{1-4}$ aliphatic carboxyperacid.

2. A bleach activator body according to claim 1 in which the first and second activators are present in a weight ratio in the range 1:10 to 10:1.

3. A bleach activator body according to claim 1 in which the body has been prepared by extrusion.

4. A bleach activator body according to claim 1 in which the relatively surface active bleach activator is a compound including one or a plurality of lower alkyleneoxy groups.

5. A bleach activator body according to claim 1 or claim 4 in which the relatively non surface active bleach activator is a $C_2$ or $C_3$ peroxy acid.

6. A bleach activator body according to claim 1 in which the relatively surface active bleach activator is a sodium or potassium $C_{6-10}$-alkanoyloxy benzene sulphonate and the relatively non surface active bleach activator is tetra acetyl ethylene diamine.

7. A bleach activator body according to claim 1 in which the disintegration aid comprises a sequestering agent or mixture of sequestering agents,

8. A bleach activator according to claim 7 in which the sequestering agent is selected from amino carboxylic acids, low molecular weight anionic polymers and phosphonic acids and their salts.

9. A bleach activator body according to claim 7 comprising a water-soluble inorganic salt.

10. A bleach activator body according to claim 1 in which the binder is selected from nonionic surfactants, polyethylene glycols and mixtures thereof having a melting point in the range 40°–80° C.

11. A bleach activator body according to claim 1 in which the activator particles have an average particle size in the range 10–500 microns.

12. A process for producing a bleach activator body comprising forming a mixture comprising:

(a) 50 to 97.5% of particulate bleach activator, which is a mixture of a relatively surface active bleach activator which, in an aqueous solution containing a peroxygen bleaching compound, produces peroxy acids and diacids having hydrocarbyl groups containing 5 to 20 carbon atoms and a relatively nonsurface active bleach activator which, in an aqueous solution containing a peroxygen bleaching compound, produces a $C_{1-4}$ aliphatic carboxyperacid, (b) 0.5 to 40% of a particulate water-soluble disintegration aid, and (c) 2 to 45% of a binder selected from nonionic surfactants, polyethylene glycols, non-ionic, film-forming polymers, and mixtures thereof, said binder being molten and having the bleach activator and disintegration aid substantially uniformly distributed throughout it, said mixture being substantially free of water and other liquid in which the disintegation and/or bleach activator is soluble, extruding said mixture, and cooling the extruded mixture to form the bleach activator body.

13. A process according to claim 12 in which the mixture is formed and extruded at a temperature in the range 20° to 80° C.

14. A particulate detergent composition containing activator bodies as defined in claim 1 in an amount in the range 1 to 5% by weight based on the total composition.

15. A composition according to claim 14 containing an inorganic peroxy bleach component.

16. A bleach activator body according to claim 4 in which the lower alkylene oxide groups are ethylenoxy groups.

17. A bleach activator according to claim 5 in which the relatively non-surface active bleach activator is an acetyl peroxyacid.

* * * * *